United States Patent [19]

Russell

[11] 4,100,015

[45] Jul. 11, 1978

[54] CHROMATE-FREE ETCHING PROCESS AND COMPOSITION FOR PREPARING ALUMINUM FOR ADHESIVE BONDING

[75] Inventor: William J. Russell, Sparta, N.J.

[73] Assignee: The United States of America as represented by the Secretary of the Army, Washington, D.C.

[21] Appl. No.: 808,504

[22] Filed: Jun. 21, 1977

[51] Int. Cl.[2] ..... C23F 1/00

[52] U.S. Cl. ..... 156/665; 252/79.2

[58] Field of Search ..... 252/79.2; 156/665, 307, 156/308, 330; 427/309

[56] References Cited

U.S. PATENT DOCUMENTS

| | | | |
|---|---|---|---|
| 3,009,849 | 11/1961 | Bellinger | 156/665 |
| 3,510,430 | 5/1970 | Mickelson et al. | 252/79.1 |

*Primary Examiner*—William A. Powell

*Attorney, Agent, or Firm*—Nathan Edelberg; Harold H. Card, Jr.; A. Victor Erkkila

[57] ABSTRACT

A chromate-free etching process and composition for treating aluminum parts to prepare a surface for durable adhesive bonding to other parts, which avoids the toxicity and disposal problems attending the use of conventional chromate containing etching baths. The process utilizes an etchant composition composed of an aqueous solution of nitric acid, alkali metal sulfate, ferric sulfate and preferably also sulfuric acid.

6 Claims, 4 Drawing Figures

Figure 1:
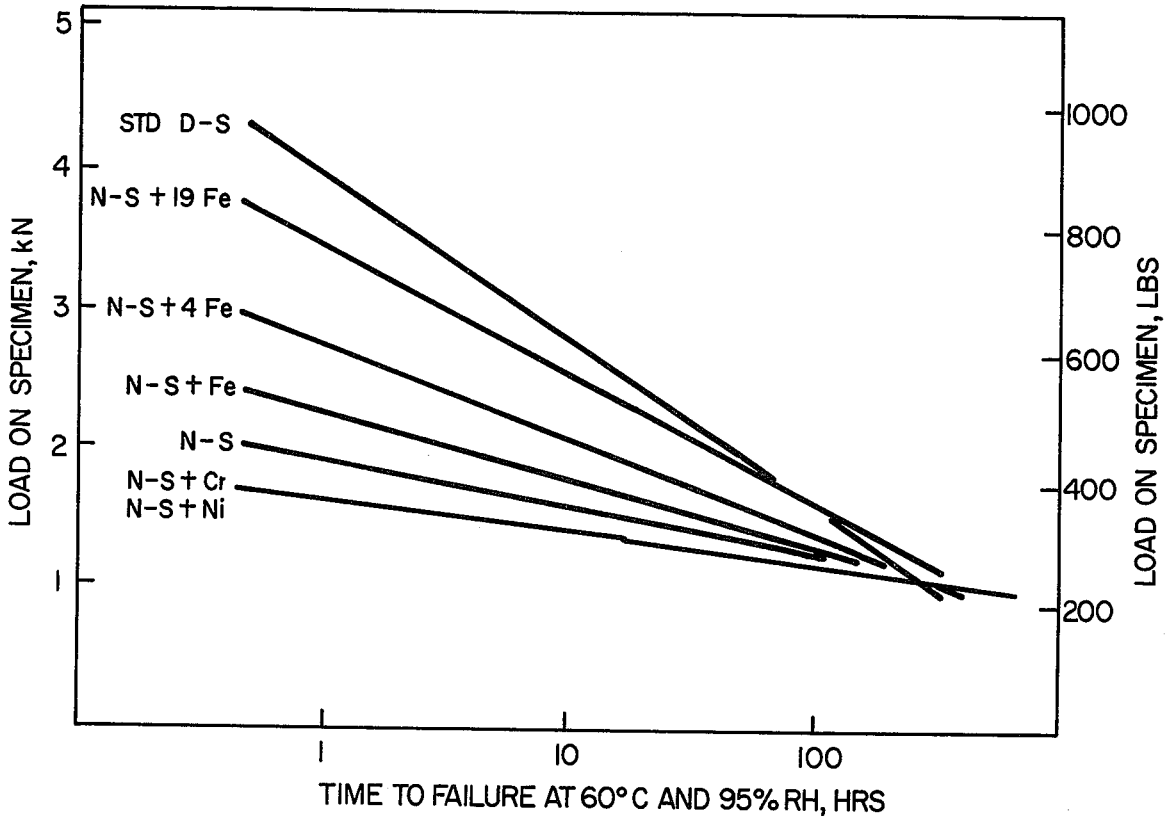

CHROMATE-FREE ETCHING PROCESS AND COMPOSITION FOR PREPARING ALUMINUM FOR ADHESIVE BONDING

GOVERNMENTAL INTEREST

The invention described herein may be manufactured, used and licensed by or for the Government for governmental purposes without the payment to me of any royalties thereon.

BACKGROUND OF THE INVENTION

The present invention relates to a chromate-free etching process and composition for the treatment of aluminum parts to produce surfaces, which can be adhesively bonded to other parts, e.g. by means of an epoxy type adhesive, to produce durable, long-life bonds.

In the past the usual procedure for preparing aluminum parts for adhesive bonding involved etching the aluminum parts, prior to application of the adhesive bonding agent, with a solution of sulfuric acid and sodium dichromate in water. The use of such etching solutions, which contained considerable concentrations of chromate, resulted in contamination of the air in the plant as well as the rinse waters used in processing the aluminum. Although the removal of such chromate contamination is possible, it is expensive and not always completely effective, which results in toxic hazards to workers and the release of toxic materials into surrounding watersheds. At present the spent etchant and chromate containing rinse waters are treated with sodium bisulfite to reduce the chromium to the trivalent state and then neutralized to pH7 to precipitate the trivalent chromium compound, after which the treated waste liquor is pumped into a settling pond where the precipitated chromium compound settles out as sludge. The precess is expensive and often ineffective if accidental spills occur. Blowers and ducts are often used to sweep away the vapors over the processing tanks, but they are not totally efficient so that the workers are exposed to the fumes which are toxic and carcinogenic.

SUMMARY AND DETAILED DESCRIPTION OF THE INVENTION

In view of the increasing governmental requirements for safer working conditions and greater environmental protection, efforts have been directed to the development of a improved etching bath for aluminum, which avoids the pollution and toxicity problems associated with the conventional acid chromate baths and yet prepares the aluminum for adhesive bonding without loss of adhesive bond strength and durability.

According to the present invention there is provided a novel process for etching aluminum utilizing a novel etchant composition, which (a) is completely devoid of chromate and hence reduces or eliminates the pollution and toxicity problems attending the use of conventional chromate containing etchant baths and (b) produces surfaces, which when adhesively bonded result in joint strengths and stress durabilities comparable to those obtained by use of conventional acid chromate etchant.

More specifically, the invention provides a novel process for etching aluminum to produce a surface for durable adhesive bonding to other parts, which utilizes a novel etchant composition consisting essentially of an aqueous solution of nitric acid, alkali metal sulfate, and ferric sulfate and preferably also sulfuric acid. Since the process and composition are totally free from chromates, there are no toxicity and disposal problems resulting from the use of chromates. The spent etchant composition and rinse waste waters can be rendered safe by neutralizing the acid components with inexpensive caustic soda or lime, which also precipitates the iron present therein. The use of the novel etchant composition of the present invention in place of the conventional acid chromate etchant bath for preparing aluminum for adhesive bonding can be accomplished without degradation of the strength and durability of the adhesive bond.

In the practice of the process of the present invention, it has been found that the percentage ranges for the chemical ingredients of the novel etching composition equivalent to the following can be employed:

| | Weight percent |
|---|---|
| nitric acid, 70% = sp.gr. 1.41 | 1 to 25 |
| sulfuric acid, 96% = sp.gr. 1.84 | 0 to 10 |
| alkali metal sulfate, anhydrous | 5 to 8 |
| ferric sulfate, 76% | 0.2 to saturated solution |
| water | 60 to 93 |

The etching composition preferably contains at least about 1% by weight of sulfuric acid, since it has been found to increase the effective useful life thereof. Also, sodium sulfate is the preferred alkali metal sulfate although other alkali metal sulfates e.g. potassium sulfate and lithium sulfate can be employed.

The process of the present invention for preparing the aluminum surface for adhesive bonding can be carried out by contacting the aluminum (which term includes pure or substantially pure aluminum as well as aluminum alloys consisting predominantly of aluminum) with the novel etchant solution for suitable periods under a wide range of temperature, for example, at 60° to 90° C for about from 5 to 30 minutes.

The following examples provide further specific illustrations of the process and compositions of the present invention.

EXAMPLES 1–7

A nitric-sulfate etch solution was prepared by dissolving 100 grams of anhydrous sodium sulfate in 150 ml of 70% nitric acid and diluting the mixture to one liter with deionized water. This nitric-sulfate etchant is frequently employed for the preparation of aluminum surfaces for resistance welding ("Resistance Welding of Aluminum", page 470, Metals Handbook, 8th Edition, Volume 6, Welding and Brazing, ASM, 1971).

Modified nitric-sulfate etch solutions were prepared by dissolving small amounts of ferric sulfate, sodium dichromate and nickel oxide in the aforesaid nitric-sulfate (N-S) etchant. These etchant solutions were employed for etching panels of 6061 aluminum alloy (composition: about 0.6% silicon, 0.27% copper, 1.0% magnesium, 0.20% chromium, balance aluminum) 1.54 mm (0.063 in) thick, which were carefully cleaned with acetone to remove all ink and oil therefrom prior to immersion in the etchant bath. The compositions of these etchant baths and the standard dichromate-sulfuric acid (D-S) etchant together with the etching cycles employed are set forth in Table I.

After removal from the etching bath, the panels were rinsed with deionized water, and the surfaces were rapidly dried with a jet of filtered, compressed air to eliminate any variable due to uncontrolled reaction with the rinse water. The specimens were then adhesively bonded and cured at 121° C (250° F), using a thermosetting epoxy adhesive AF126-3 marketed by the 3M Company. The specimens were 25.4 mm (1 inch) wide and had an adhesive lap joint of 12.7 mm (0.5 inch).

The bonded specimens thus obtained were tested for stress durability by placing each specimen in a spring loaded jig and subjecting it to a test environment including a temperature of 60° C and an atmosphere of 95% relative humidity (see 20 ASTM D 2919-71 Standard Recommended Practice for Determining Durability of Adhesive Joints Stressed in Shear by Tension Loading). The times to failure were automatically recorded.

The test results are set forth graphically in FIG. 1. They show that the bonds obtained on surfaces prepared with the chromium or nickel modified N-S etchant were inferior to those obtained on surfaces prepared with the unmodified (N-S) etchant, whereas the bonds obtained on surfaces prepared with the iron modified N-S etchant showed a significant improvement. Also, the bond durability increased as the iron concentration was increased and was greatest at the higher stress levels, where it was comparable to the values obtained with the standard chromate (D-S) etchant. At approximately 250 pounds all curves come to nearly a common point, indicating that changes in etchant composition have a minimal effect at these lower levels.

Series of comparative adhesive bonding tests were carried out in the foregoing manner using two different aluminum alloys, 6061 (composition noted above) and 2024 (composition: about 4.4% copper, 0.6% manganese, 1.5% magnesium balance aluminum,) and older and newer types of epoxy adhesives. One series of panels was prepared using the standard chromate etchant, while the other was prepared with the novel etchant of example 7, as described above.

Figure 2:
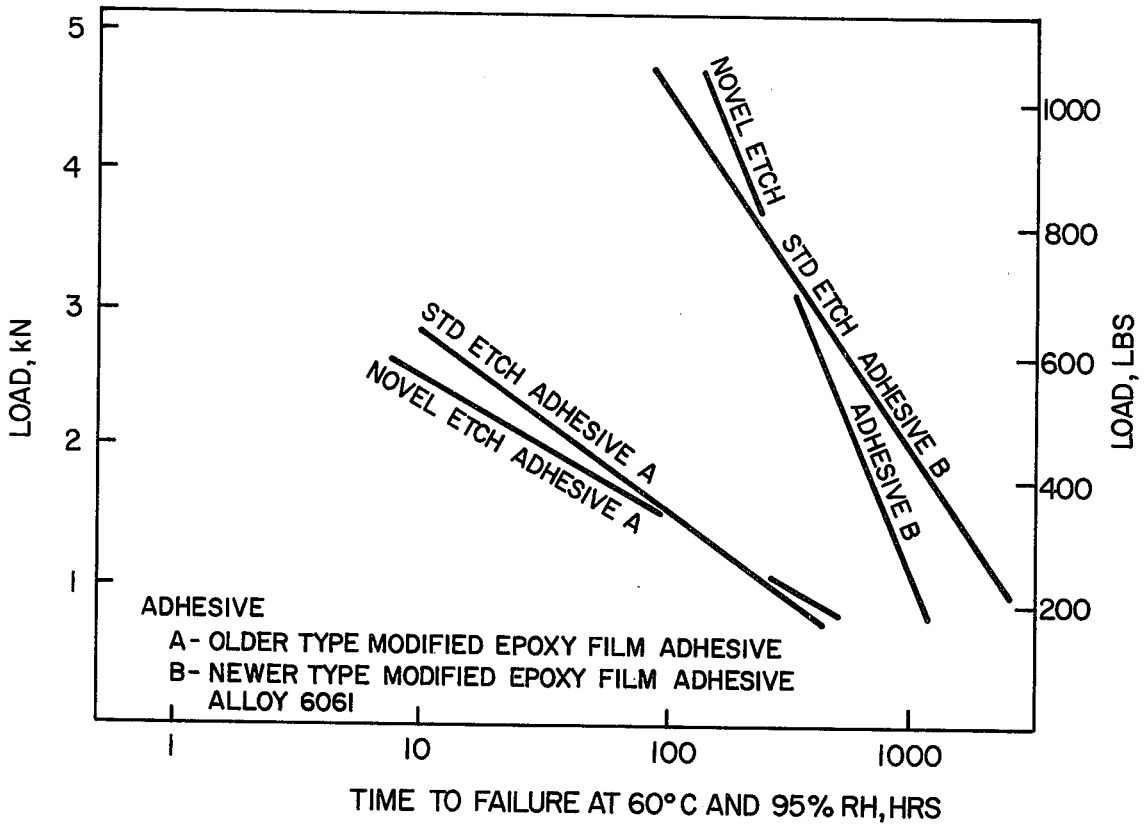
Figure 3:
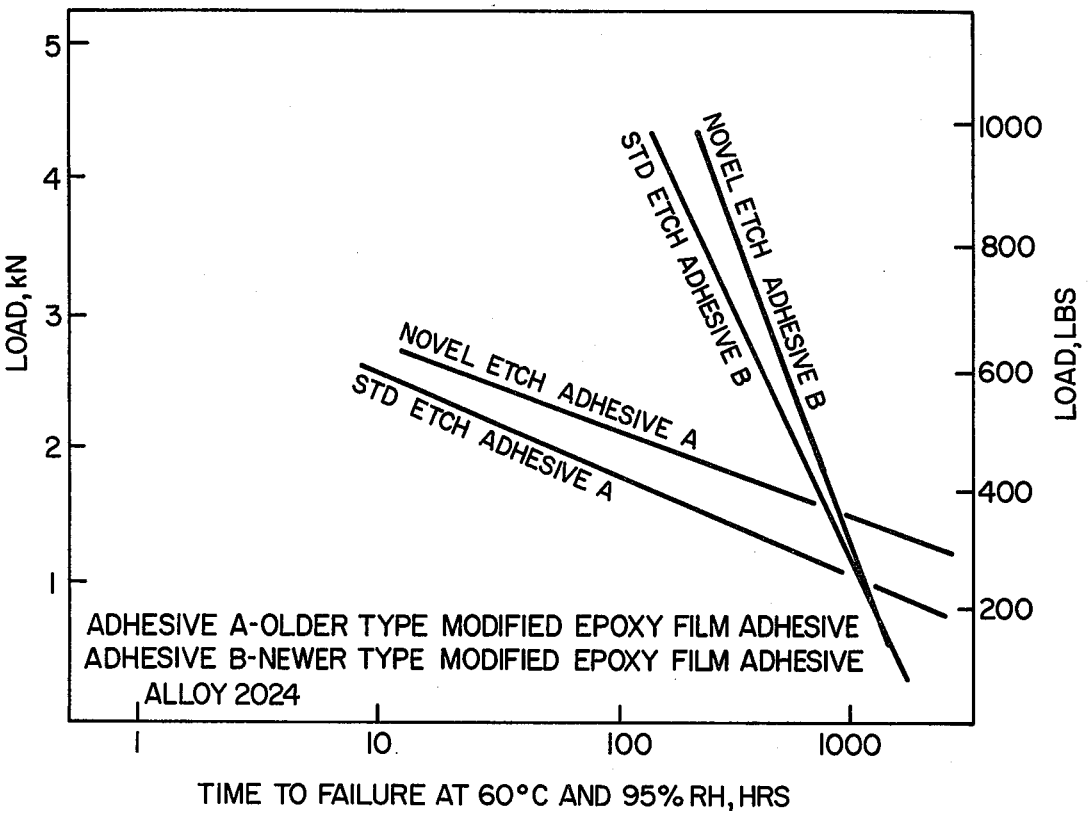

The test results with alloy 6061 are set forth in FIG. 2, which shows that both sets of curves are essentially the same and are well within the expected experimental error. The curves obtained with the older epoxy adhesive shown that the novel etchant is slightly superior at lower stress levels but inferior at higher levels, whereas the curves obtained with the newer epoxy adhesive show the opposite results. The test results with alloy 2024 are set forth in FIG. 3, with indicates that the novel etchant is slightly superior with both adhesives. When the tensile specimens were tested to failure at room temperature and at 60° C., the bonds possessed essentially the same tensile strength with either etchant.

Similar results were obtained when aluminum alloys 5052 (composition: 2.5% magnesium, 0.25% chromium, balance aluminum) and 7075 (composition: 1.6% copper, 2.5% magnesium, 0.30% chromium, 5.6% zinc, balance aluminum) were employed with the aforesaid epoxy adhesives.

Essentially equivalent bond strengths were obtained with the novel etchant of example 7 and the standard chromate etchant when an acrylic type adhesive was employed.

TABLE I

| Example | Etchant | $H_2SO_4$ (d.l.84) ml. | $Na_2SO_4$ (anhyd.) gms. | $HNO_3$ (70%) ml. | $Na_2Cr_2O_7 \cdot 2H_2O$ gms. | $Fe_2(SO_4)_3$ (75.7%) gms. | NiO gms. | Deionized Water ml. | Etch min. | Cycle ° C |
|---|---|---|---|---|---|---|---|---|---|---|
| 1 | D-S(Std) | 181 | | | 33.3 | | | 1000 | 9 | 68±3 |
| 2 | N-S | | 100 | 150 | | | | * | 6 | 83±3 |
| 3 | N-S+Cr | | 100 | 150 | 9.4 | | | * | 6 | 77±3 |
| 4 | N-S+Fe | | 100 | 150 | | 2.9 | | * | 6 | 74±3 |
| 5 | N-S+Ni | 5.3 | 100 | 158 | | | 6.25 | * | 6 | 83±3 |
| 6 | N-S+4Fe | | 100 | 150 | | 11.5 | | * | 9 | 66±3 |
| 7 | N-S+19Fe | 20.2 | 69.2 | 218 | | 54.1 | | * | 12 | 66±3 |

*Diluted with deionized water to make 1 liter of etchant

Figure 4:
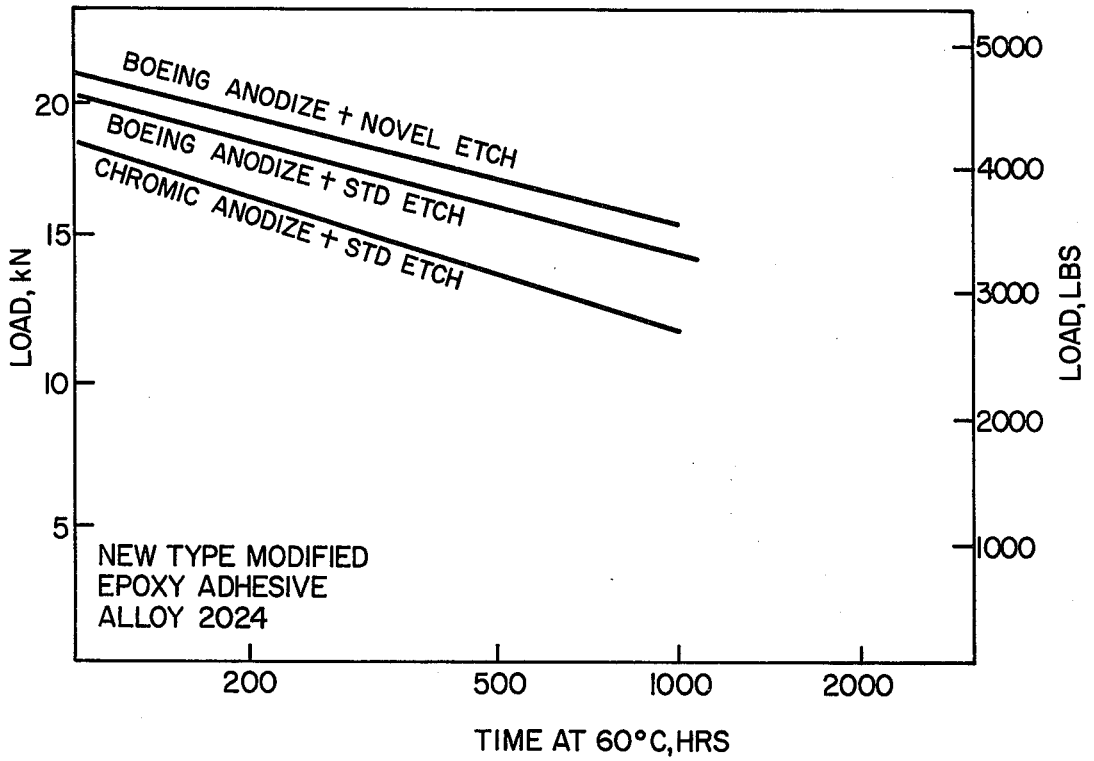

The novel etchant of the present invention also permits an entirely chromate-free process for preparing an anodic surface on aluminum prior to adhesive bonding. At present two different prebonding anodic surface treatments are employed, namely the chromic acid anodizing process and the recently introduced Boeing phosphoric acid anodizing process. Neither of these processes is free from chromate, since they both utilize the standard sulfuric acid-dichromate etchant as a pretreatment prior to the anodizing step. FIG. 4 sets forth a graphical comparison of three systems for prebonding anodic surface treatments using aluminum alloy 2024 and the newer type modified epoxy adhesive, viz.

(1) The standard chromic acid anodize process using the standard sulfuric acid sodium dicromate etchant;

(2) The new Boeing phosphoric acid anodize process using the standard sulfuric acid-sodium dichromate etchant; and (3) The new Boeing phosphoric acid anodize process using the novel etchant of example 7.

As shown in FIG. 4, the hot water soak durability* of the bond obtained with the new Boeing phosphoric acid anodize process using the novel etchant of the present invention is superior to that obtained when the standard sulfuric acid-dichromate etchant was employed with either the chromic acid or the phosphoric acid anodize process.

*The same type of lap shear specimen was employed as was used for the shear durability tests described above. The bonded specimens were submerged in deionized water at 60° C for prescribed periods, then placed in a small container of water at 60° C and transferred to the test chamber of the standard tensile machine maintained at 60° C. Each specimen was removed from the container, placed into the grips and a thermocouple attached to the surface of the bond area. When the specimen reached 60° C, it was tested to failure at a constant rate of load of 16.5 - 19.3 M Pa/Min.

The foregoing disclosure and drawings are merely illustrative of the principles of this invention and are not to be interpreted in a limiting sense. I wish it to be understood that I do not desire to be limited to the exact details of construction shown and described, because obvious modifications will occur to a person skilled in the art.

What is claimed is:

1. The method of adhesive bonding of aluminum parts, wherein the aluminum parts are subjected, prior to adhesive bonding, to an etching process to produce a surface preparatory to adhesive bonding, which comprises contacting the aluminum part with a chromate-free etching composition consisting essentially of:

1 to 25 weight percent nitric acid 0 to 10 weight percent sulfuric acid 5 to 8 weight percent alkali metal sulfate 0.2 weight percent to saturated solution of ferric sulfate 60 to 93 weight percent water 2. The method of claim 1, wherein the composition contains at least about 1 percent by weight sulfuric acid.

3. The method of claim 1, wherein the alkali metal sulfate is sodium sulfate.

4. A composition for etching aluminum perparatory to adhesive bonding which consists essentially of:

1 to 25 weight percent nitric acid 0 to 10 weight percent sulfuric acid 5 to 8 weight percent alkali metal sulfate 0.2 weight percent to saturated solution of ferric sulfate 60 to 93 weight percent water 5. The composition of claim 4, wherein the content of sulfuric acid is at least about 1% by weight.

6. The composition of claim 4, wherein the alkali metal sulfate is sodium sulfate.

* * * * *